United States Patent [19]

Atchisson

[11] Patent Number: 4,522,105

[45] Date of Patent: Jun. 11, 1985

[54] FIRING MECHANISM FOR SEMIAUTOMATIC FIREARMS

[75] Inventor: Maxwell G. Atchisson, Doraville, Ga.

[73] Assignee: SW Daniel, Inc., Atlanta, Ga.

[21] Appl. No.: 501,705

[22] Filed: Jun. 6, 1983

[51] Int. Cl.[3] ..... F41C 19/00

[52] U.S. Cl. ..... 89/139; 42/69 B; 89/195

[58] Field of Search ..... 89/139, 148, 149, 150, 89/154, 195; 42/20–22, 69 B

[56] References Cited

U.S. PATENT DOCUMENTS

| | | | |
|---|---|---|---|
| 659,507 | 10/1900 | Browning | 89/139 X |
| 2,090,340 | 8/1937 | Browning | 89/148 X |
| 2,136,396 | 11/1938 | Savage | 89/195 X |
| 2,361,519 | 10/1944 | Williams | 89/139 |
| 2,365,142 | 12/1944 | Turner | 89/154 X |
| 2,366,823 | 1/1945 | Williams | 89/139 |
| 3,651,736 | 3/1972 | Ingram | 89/195 X |
| 3,942,410 | 3/1976 | Atchisson | 89/139 |
| 4,352,317 | 10/1982 | Wilhelm | 89/154 |
| 4,421,009 | 12/1983 | Castellano et al. | 89/149 X |

*Primary Examiner*—David H. Brown
*Assistant Examiner*—John E. Griffiths
*Attorney, Agent, or Firm*—Jones & Askew

[57] ABSTRACT

A semiautomatic firing mechanism for an autoloading firearm. A generally C-shaped hammer is pivotably mounted behind a bolt, with a transversely-extending sear piece located below the rearwardly-facing open side of the hammer. The open ends of the hammer provide ledges selectively engageable with primary and secondary sear surfaces on the sear piece.

12 Claims, 11 Drawing Figures

FIRING MECHANISM FOR SEMIAUTOMATIC FIREARMS

FIELD OF INVENTION

This invention relates in general to firearms, and in particular relates to firing mechanisms intended for semiautomatic firearms such as pistols or the like.

BACKGROUND OF THE INVENTION

Firing mechanisms for firearms should meet a number of criteria. The firing mechanisms should be relatively lightweight so as not to add unnecessary weight to the gun, and yet must also be sturdy and dependable. Moreover, the number of component parts in the firing mechanism should be minimized, and these parts preferably should be easily formed without requiring undue amounts of machining, so as to keep down the overall cost of manufacturing and assemblying the firearm.

Still another criterion, particularly with so-called "automatic" or autoloading semiautomatic-firing firearms which fire a single round each time the trigger is pulled, is a firing mechanism which cannot easily be converted to full-automatic firing. A particular case in point involves the "Ingram" pistol, a version of which is disclosed in U.S. Pat. No. 3,651,736. The firearm as disclosed in that patent is designed and intended for full-automatic firing, that is, the pistol automatically reloads and fires while the trigger is pulled, until all rounds in the magazine are fired. Although a semiautomatic-fire version of this pistol has been produced, it is nonetheless desirable to provide an improved semiautomatic firing mechanism which fits within the basic frame envelope of the pistol with minimum modifications, which yields dependable hammer-fired operation with an economy and simplicity of firing mechanism components, and which is not readily convertible to full-automatic firing without substantially rebuilding the gun.

SUMMARY OF INVENTION

Stated in general terms, the firing mechanism of the present invention includes a hammer selectably held in cocked position, or released for firing, by selective engagement with a sear extending between two confronting sear-engaging surfaces associated with the hammer. The sear member includes a primary sear surface and a secondary sear surface, and these sear surfaces may selectably be engaged by corresponding sear-engaging surfaces associated with the hammer. The primary sear surface holds the hammer cocked, and the primary sear surface becomes disengaged from the hammer when the trigger is pulled. If the trigger remains pulled as the hammer is returned to the cocked position by rearward bolt travel upon firing the gun, the other sear-engaging surface associated with the hammer engages the secondary sear surface, retaining the hammer behind cocked position and preventing the hammer from striking the firing pin as the bolt moves forward to chamber a new round. When the trigger is released, the hammer returns to engagement with the primary sear surface of the sear member, in cocked position.

Stated somewhat more particularly, the present firing mechanism includes a hammer having a pair of mutually spaced apart elements, flanking the sear member extending in the space between elements. The primary and secondary sear surfaces are on opposite sides of the sear member, closely spaced apart from corresponding sear engaging surfaces of the hammer when positioned in cocked or behind-cocked positions. The sear member is normally urged into a position where the primary sear surface is engaged by the hammer in cocked position.

Stated in somewhat greater detail, the sear member engages a pair of elongated members extending forwardly within the frame of the gun, and slidably movable therein as the trigger is pulled or released. Sliding rearward movement of the elongated members and the associated sear member releases the hammer to effect firing, and the sear member thus is held in position for engagement by the secondary sear-engaging hammer element as long as the trigger remains pulled.

Accordingly, it is an object of the present invention to provide an improved firing mechanism for firearms.

It is another object of the present invention to provide a firing mechanism especially useful for hammer-fired semiautomatic firearms such as pistols or the like.

It is still another object of the present invention to provide a firing mechanism for hammer-fired semiautomatic pistols, and not readily convertible to full-automatic operation.

Other objects and advantages of the present invention will become more readily apparent from the following description of a preferred embodiment.

BRIEF DESCRIPTION OF DRAWINGS

FIG. 3 is a partial section view of the gun shown in FIG. 1, showing the gun cocked and with the safety on.

DESCRIPTION OF PREFERRED EMBODIMENT

Figures 1, 7, 10, 11:
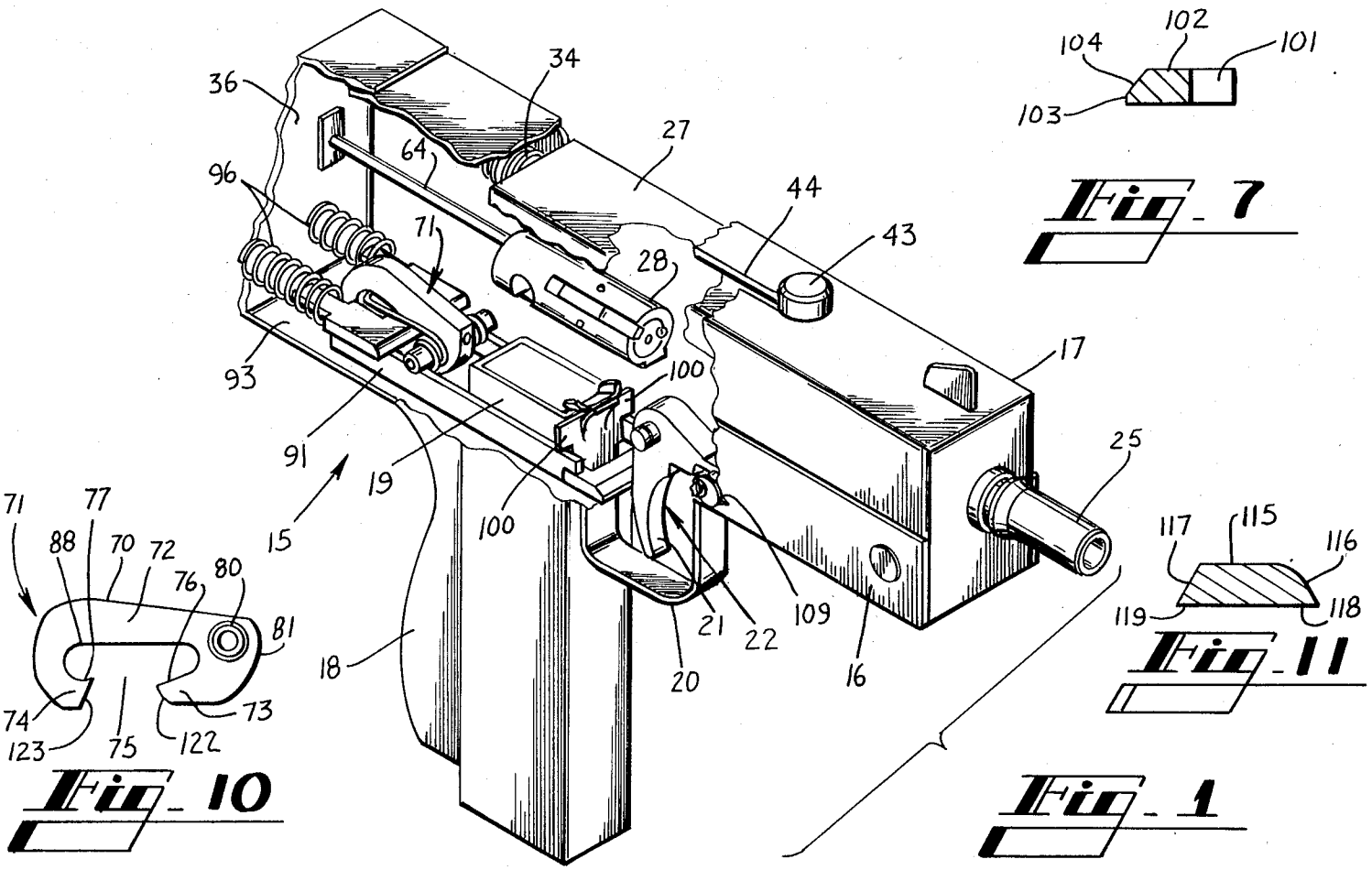
FIG. 1 is a pictorial view, shown partly broken away for illustrative purposes, of a pistol equipped with a firing mechanism according to a preferred embodiment of the present invention.
FIG. 7 is a section view taken along line 7—7 of FIG. 2, showing details of the trigger bar.
FIG. 10 is a plan view of the hammer in the disclosed embodiment.
FIG. 11 is a section view taken along line 11 of FIG. 2.

Turning first to FIG. 1, a firing mechanism according to the disclosed embodiment of the present invention is disposed in a pistol shown generally at 15. The pistol has a frame including a lower receiver 16 and an upper receiver 17, each of which is fabricated from sheet metal as known to those skilled in the art. A hand grip 18 extends downwardly from the lower receiver 16, and the hand grip includes a receptacle for receiving a conventional cartridge-feeding magazine 19. A trigger guard 20 is mounted immediately in front of the hand grip 18, and the finger-engaging portion 21 of a trigger 22 extends within the trigger guard.

Figure 2:
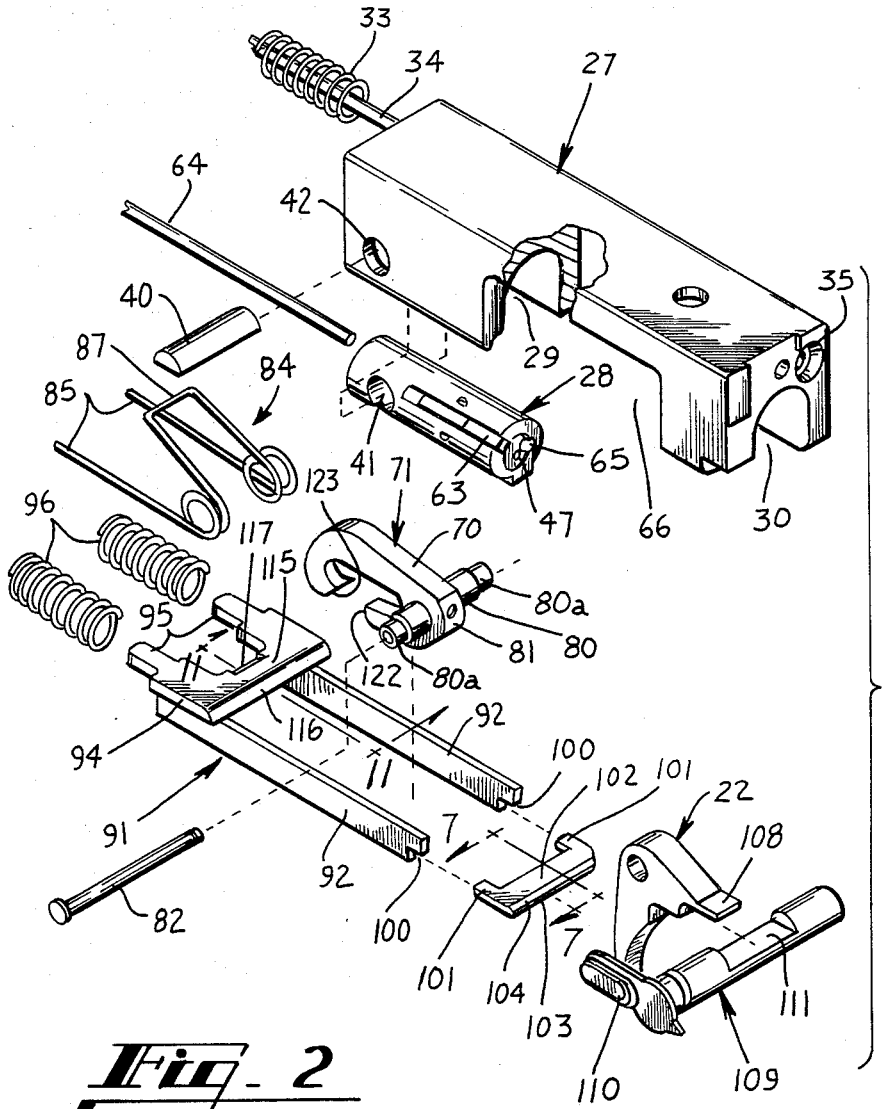
FIG. 2 is an exploded view showing certain ones of the elements from FIG. 1.

The piston 15 has a barrel 25 extending forwardly from the front end of the upper receiver 17, and the inner end of the barrel terminates in a breech end 26 (FIG. 3) chambered to receive a cartridge of appropriate caliber. A bolt body 27 is slidably mounted within the upper receiver 17, and the bolt body carries a cylindrical bolt insert 28 within a hemispherical recess 29 formed in the underside of the bolt body. Another recess 30 (FIG. 2) is formed in the underside of the bolt body 27 adjacent the front end thereof, permitting the bolt body to slide back and forth over the rear portion of the barrel.

The bolt body 27 is biased forwardly by the recoil spring 33 telescopically received over the recoil rod 34, which slidably extends into the longitudinal recoil rod hole 35 formed in the bolt body 27. The back end of the recoil rod 34 abuts the back wall 36 of the lower receiver 16.

The bolt insert 28 is removably retained in the bolt-receiving recess 29 of the bolt body 27 by the bolt insert pin 40, which extends through the transverse opening 41 in the bolt insert and through aligned mating openings 42 in each side of the bolt body recess 29. The bolt insert 28 thus is fixed to the bolt body 27 and travels back and forward with the bolt body. A bolt actuating handle 43 (FIG. 1) is attached to the top of the bolt body 27, and extends outwardly through the slot 44 in the top of the upper receiver 17.

It will be understood that the front face 47 of the bolt insert 28 is configured to fit the head of the particular cartridge for which the pistol 15 is chambered. It should also be understood that different models of a particular pistol may be chambered for cartridges of different calibers, in which case the bolt body 27 may be a universal bolt body configured for use in such guns of different calibers. Where the bolt body 27 is a universal bolt body, it will be understood that a different bolt insert 28 configured for the particular caliber must be fitted in the universal bolt body in the manner described above.

Figure 6:
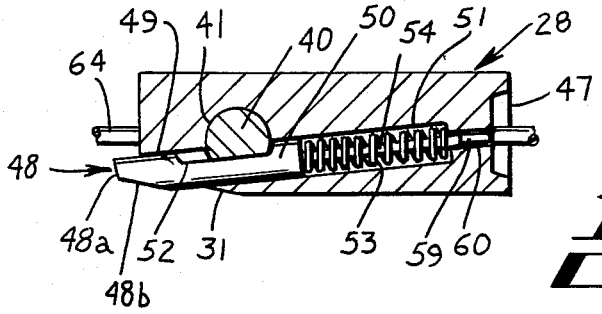
FIG. 6 is a vertical section view of the bolt insert in the disclosed embodiment.

Turning to FIG. 6, it is seen that the bolt insert 28 carries a floating firing pin 48 received for reciprocal movement within the firing pin hole 49 longitudinally extending through the bolt insert. The firing pin 48 includes a rear portion 50 of diameter sufficient for a smooth sliding fit within the enlarged-diameter portion 51 of the firing pin hole 49. A transverse notch 52 is formed across part of the firing pin enlarged portion 50, and the bolt insert pin 40 (which retains the bolt insert 28 in the bolt body 27) extends through the notch 52 in the firing pin. The width of the bolt insert pin 40 is less than the corresponding dimension of the firing pin notch 52, thus retaining the firing pin for a limited extent of longitudinal movement within the bolt insert 28. A firing pin spring 53 surrounds the shank portion 54 of the firing pin, in front of the enlarged portion 50, and the firing pin spring urges the firing pin rearwardly so that the back end of the firing pin protrudes behind the back end 58 of the bolt insert. When the firing pin is struck by the hammer as described below, the firing pin travels forwardly within the bolt insert and the forward end 59 of the firing pin emerges from the firing pin hole 60 in the front face 47 of the bolt insert. In this manner, a chambered round is fired.

The bolt insert 28 carries an extractor 63 of conventional design, to extract cartridges from the breech as the bolt body 27 and the bolt insert 28 move back within the receiver. A fixed ejector pin 64 slidably extends through a mating longitudinal hole 65 in the bolt insert 28. The forward end of the ejector pin 64 is located within the upper receiver so that cartridges are ejected through the ejection port 66 of the bolt body 27 during rearward travel of the bolt body. It will be understood that the right side of the upper receiver 17, shown cutaway in FIG. 1, is provided with an ejection port located to be aligned with the ejection port 66 of the bolt body as cartridge ejection occurs.

Figure 3:
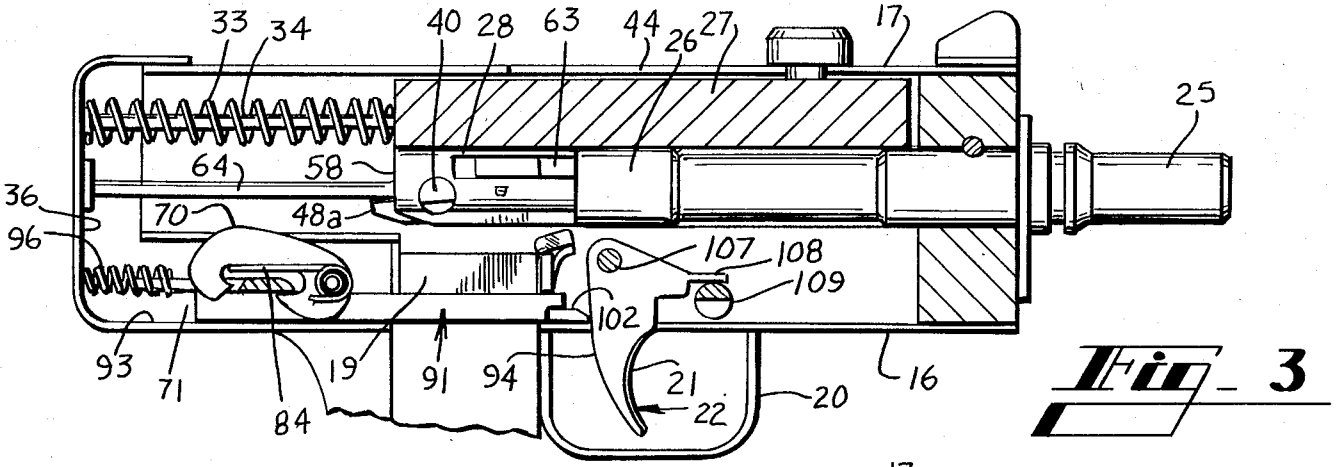

The back end **48*a* of the firing pin 48 protrudes behind the back of the bolt body 27 as best seen in FIG. 3, in position to be struck by the forward surface 70 of the hammer 71. The hammer 71, as best seen in FIG. 10, is a generally C-shaped member having a body 72 terminating in two ends 73, 74 curved inwardly to confront each other across an open space 75. The hammer ends 73 and 74 of the C-shaped hammer are spaced apart from the hammer body 72 so that the hammer ends define respective ledge surfaces 76, 77 facing inwardly toward the inside of the hammer body. The outside surface 70 of the hammer body 72 is the forementioned forward surface for striking the back end 48*a*** of the firing pin.

A hollow hammer axle 80 extends outwardly from both sides of a first end 81 of the hammer 71. The exterior surface at the ends of the hammer axle form the reduced radii **80*a* which keep the sear assembly from moving upward, as described below. The hammer axle 80 may be machined as an integral unitary part of the hammer 71, or alternatively may be separately formed as a tubular member secured in a hole at the first end 81 of the hammer. In either case, a bearing hole extends through the hammer axle 80 and the hammer, and the hammer pivots on the hammer pin 82 (FIG. 2) extending through the opening in the hammer axle. It will be understood that the hammer pin 82, in the assembled pistol 15, is secured in aligned openings on each side of the lower receiver 16, to mount the hammer 71 for pivotable movement below and behind the bolt body 27, in the forward position shown in FIGS. 4 and 5**.

Figure 4:
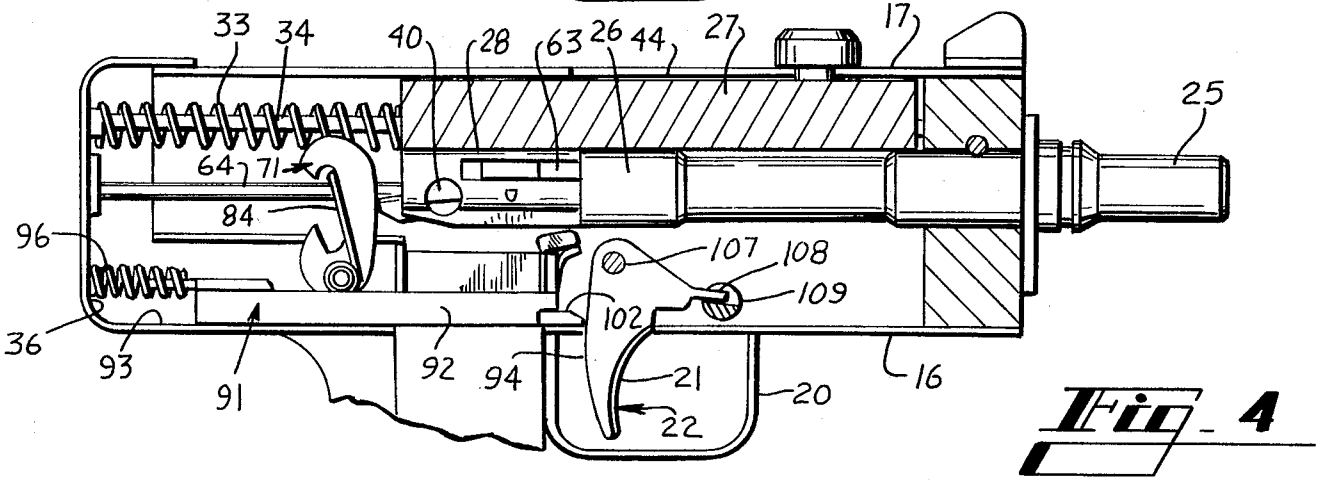
FIG. 4 is a vertical section view as in FIG. 3, except that the hammer is forward and the trigger is pulled.

A double torsion hammer spring 84 urges the hammer 71 to the forward position shown in FIG. 4. The hammer spring 84 includes a pair of legs 85 which lie against the inside bottom surface 93 of the lower receiver 16, and also includes a free loop 87 which engages the body 72 of the hammer 71 within the inside flat surface 88 adjacent the rear hook-shaped end 74 of the hammer.

Situated below the hammer 71 in the lower receiver 16 is the sear assembly 91. The sear assembly 91 includes a pair of laterally spaced-apart parallel rails 92 slidably resting on the bottom plate 93 of the lower receiver 16. A cross member 94 is secured to the upper sides of the rails 92 adjacent the back ends of the rails, and this cross member maintains the spaced-apart arrangement of the rails. A pair of spaced-apart tangs 95 project rearwardly from the back of the cross member 94, with the tangs not being directly behind the rails 92. The spacing between the rails 92 is somewhat less than that of the tangs 95, placing the rails in from the adjacent sides of the lower receiver 16 for clearing of the radii along each side of the lower receiver. The front ends of separate compression coil sear springs 96 fit over the outer ends of the tangs 95, and the back end of each sear spring engages the back wall 36 of the lower receiver 16. With the firing mechanism assembled as shown in FIG. 1, the sear springs 96 are maintained in compression and urge the sear assembly 91 forwardly within the lower receiver. Each reduced radius 80*a* of the hammer axle 80 rests just above the top surface of a corresponding rail 92, as shown in FIG. 1, and the reduced radii thus keeps the rails from moving upwardly within the lower receiver.

Figure 9:
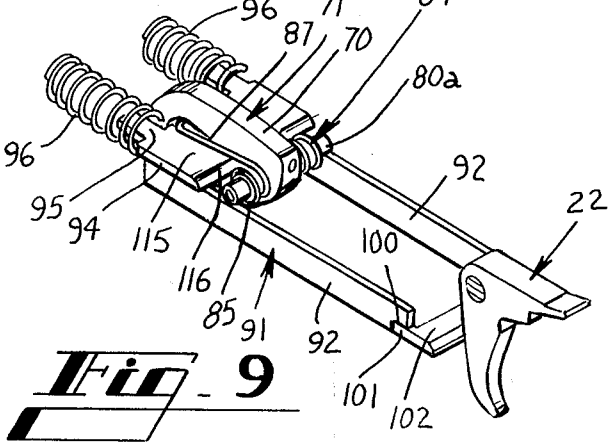
FIG. 9 is a pictorial view of the firing mechanism shown in FIG. 8, with the trigger released and the hammer held in cocked position by the primary sear.
Figure 8:
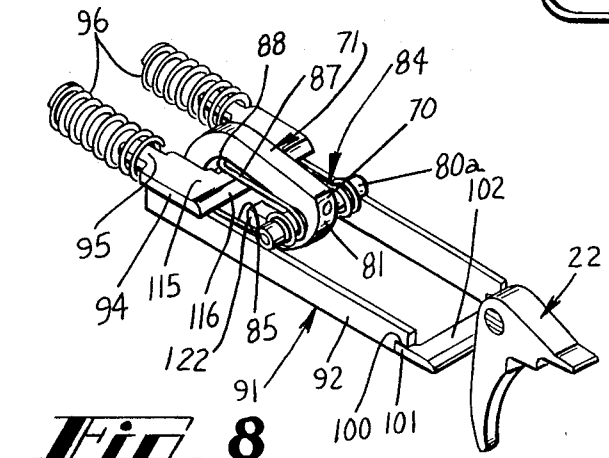
FIG. 8 is a pictorial view showing the firing mechanism of the preferred embodiment, with the trigger pulled and the hammer held by the secondary sear.

The cross member 94 of the sear assembly 91 includes a sear bridge 115 located above and between the rails 92. The sear cross member 94 is located in relation to the hammer 71 so that the sear bridge 115 is substantially aligned with the open space 75 at the back of the hammer when in cocked position, as seen in FIGS. 1, 8, and 9. As will become apparent, the front-to-back dimension of the sear bridge 115 is approximately the same as the distance 75 between ends 73 and 74 of the hammer. Because of the angled faces on the front and back faces of the sear bridge, together with the angles and relative locations of the confronting surfaces 122 and 123 of the hammer, the sear bridge can pass through the space 75 as explained below.

The forward face 116 of the sear bridge 115 is sloped backwardly from bottom to top as best seen in FIG. 11. The rear face 117 of the sear bridge is sloped forwardly from bottom to top, causing the sear bridge to have approximately the cross-shape of a trapezoid. As is explained below, the bottom surface 118 adjacent the front face of the sear bridge 115 comprises the primary sear surface, and the bottom surface 119 adjacent the rear face 117 comprises the secondary sear surface.

Figure 5:
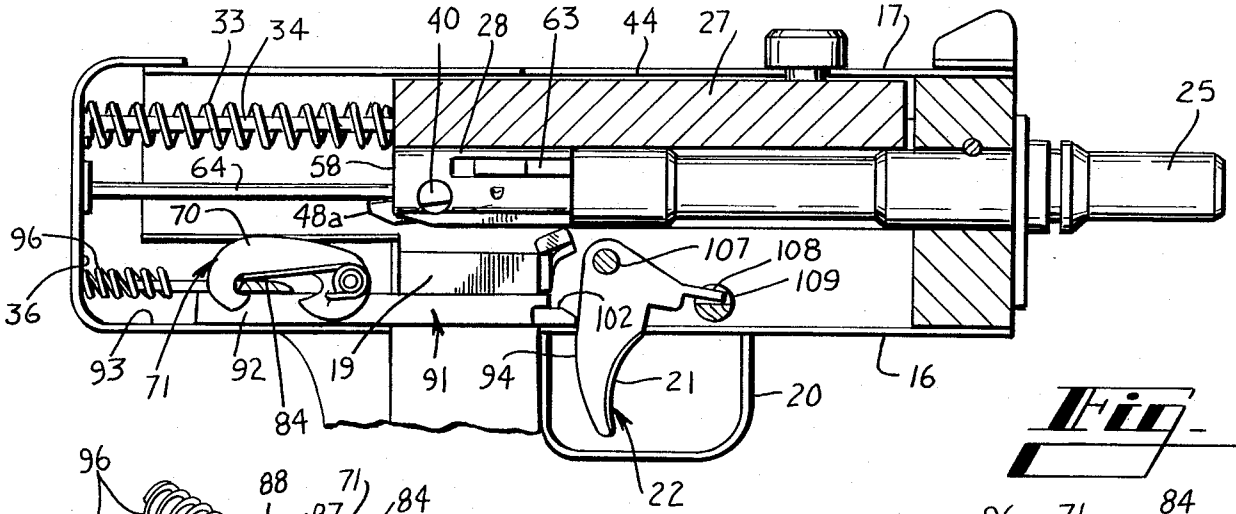
FIG. 5 is a section view as in FIG. 3, except that the trigger remains pulled and the hammer is held by the secondary sear surface.

The sear rails 92 extend forwardly on both sides of the magazine 19, and slidably fit beneath the fingers 100 which prevent upward movement of the rails. The front end of each sear rail 92 has an undercut notch 100, best seen in FIG. 2 in front of the magazine, to receive the complementary projections 101 of the trigger bar 102. The trigger bar 102, which in the disclosed embodiment is a separate element from the sear rails 92, slidably rests on the bottom plate 93 of the lower receiver, as best seen in FIGS. 3–5.

The trigger bar 102 in assembly is mounted immediately in back of the trigger 22, FIG. 3, and the forward bias of the sear springs 96 urge the front side 103 of the trigger bar against the back 94 of the trigger. The front side of the trigger bar 102 preferably includes a beveled surface 104, best seen in FIG. 7, extending part-way down from the top of the trigger bar, thereby defining a narrowed trigger-engaging front side 103 providing a more precise "feel" to the firing mechanism.

The trigger 22 is pivotably mounted on the trigger pin 107 in conventional manner. Pulling the finger engaging portion 21 of the trigger 22 thus pivots the trigger to move back the trigger bar 102 and the rest of the rest of the sear assembly 91, in opposition to the sear springs 96.

A tang 108 extends from the front side of the trigger 22, located immediately above the safety member 109. The safety member 109 is mounted for selective rotation by the operating lever 110 located on the outside of the lower receiver, and one side of the safety member includes a release notch 111 positioned below the tang 108 on the trigger. The release notch 111 receives the trigger tang 108 when the trigger is pulled, thus permitting normal firing action as illustrated in FIGS. 4 and 5. Rotating the operating lever 110 one-half turn places the solid portion 112 of the safety member immediately below the tang 108, blocking trigger movement and thus representing the "safety on" position shown in FIG. 3.

One end 73 of the hammer 71 has a beveled or otherwise acutely-angled lower surface 122 which, in assembly, confronts the forward face 116 of the sear bridge 115. Similarly, the back end 74 of the hammer has a beveled or otherwise acutely-angled lower surface 123 confronting the rear face 117 of the sear bridge 115, when the hammer is moved back to the cocked position. The angled surfaces 122 and 123 of the hammer 71 are contiguous with the corresponding ledges 76 and 77, at the respective ends of the hammer.

The operation of the above-described firearm is now discussed, with particular emphasis on the firing mechanism. The firearm is cocked in the usual manner, by pulling back the operating lever 43 to slide back the bolt body 27 and the bolt insert 28. The rearwardly-traveling bolt engages the forward surface 70 of the hammer 71, pivoting the hammer rearwardly about the hammer pin 82. The back end of the bolt insert 28 is tapered on the underside as shown at 31, FIG. 6, and the back end 48*a* of the firing pin 48 is beveled at 48*b*, to provide camming surfaces for engaging the hammer. As rearward travel of the bolt assembly continues, the hammer 71 pivots back until the angled surface 122 at the first end 73 of the hammer engages the beveled forward surface 116 on the sear bridge 115. The sear bridge 115, and thus the entire sear assembly 91, is cammed rearwardly as the hammer surface 122 engages and traverses the forward face 116 of the sear bridge. As the hammer surface 122 moves beyond the lower edge of the sear forward surface 116, the sear springs 96 move the sear assembly forward, placing the primary sear surface 118 of the sear bridge 115 in engagement above the ledge 76 at the first end 73 of the hammer 71. The hammer is now cocked, held in that position by engagement of the ledge 76 with the primary sear surface 118. This condition is shown in FIGS. 3 and 9. The beveled surface 123 at the back of the hammer is located so as not to contact the confronting rear face 117 of the sear bridge when the hammer pivots back no further than the cocked position illustrated in FIG. 3.

When the trigger 22 is pulled, the sear assembly 91 moves back until the sear bridge 115 disengages the ledge 76 of the hammer. The hammer now falls under power of the hammer spring 84, striking the back end 48*a* of the firing pin as shown in FIG. 4 and causing a chambered round (if present) to be fired. This firing produces blowback movement of the bolt insert and bolt body, repeating the cocking procedure described above.

If the trigger 22 remains pulled during the cocking procedure, it will be understood that the primary sear surface 118 on the sear bridge 115 remains back and out of possible engagement with the forward ledge 76 on the hammer. In that case, the rear surface 117 of the sear piece is positioned for camming engagement by the beveled surface 123 at the back end 74 of the hammer, after the hammer pivots back beyond the cocked position. This camming engagement between the hammer surface 123 and the sear bridge cams forwardly the sear assembly 91 against the remaining trigger-pulling force, and this force immediately moves the sear assembly rearwardly to engage the rear ledge 77 of the hammer by the secondary sear surface 119 at the back side of the sear bridge 115. The hammer 71 thus remains held in the secondary-sear position shown in FIGS. 5 and 8, as the bolt assembly travels forward under power of the recoil spring 33. When the trigger is released, the sear bridge 115 moves forwardly to disengage the secondary sear surface 119 from the hammer and position the primary sear surface 118 to engage the forward ledge 76 of the hammer, in the cocked position shown in FIG. 3. The hammer thus pivots forwardly a relatively short amount, determined by the relative angular-engagement positions of primary and secondary sear surfaces with the respective ledges on the hammer. It can be particularly seen from FIG. 10 that the primary sear-engaging forward ledge 76 of the hammer is angularly depressed by a slight amount relative to the secondary sear-engaging ledge 77, with reference to the pivot axis of the hammer.

It will thus be seen that the firing mechanism as disclosed herein is relatively straightforward in design and operation, and is configured to fit within the confines of a hand gun or the like. The secondary sear arrangement retains the hammer from forward movement while the trigger remains pulled, preventing accidental second-fires which might result if the hammer were allowed to follow the bolt forward after loading a new round. It will also be seen that the present firing mechanism is not readily or easily convertible to full-automatic firing, and any such conversion would require substantial redesign and reconstruction of the firing mechanism.

It will also be understood that the foregoing relates only to a preferred embodiment of the present invention, and that numerous modifications and alterations may be made therein without departing from the spirit and scope of the invention as defined in the following claims.

I claim:

1. Firing mechanism for a firearm, comprising:

hammer means movable along a path including a firing position and a cocked position;

means biasing said hammer means for pivotal movement toward the firing position;

said hammer means having first and second confronting surfaces defining an opening in the hammer means, and having primary and secondary sear engaging surfaces, said primary sear engaging surface adjacent said first confronting surface, said secondary sear engaging surface adjacent said second confronting surface, said primary and secondary sear engaging surfaces positioned in mutually spaced apart relation across said opening;

sear means disposed between said primary and secondary sear engaging surfaces, and selectably movable between a first position and a second position;

said sear means having a primary sear surface located for engagement by said primary sear engaging surface as said hammer means is moved to the cocked position, so as to retain the hammer means in the cocked position when the sear means is in said first position;

said sear means having a secondary sear surface located for engagement by said secondary sear engaging surface as said hammer means is pivoted beyond the cocked position, with said sear means moved to said second position so that the primary sear engaging surface cannot engage the sear means, thereby retaining the hammer means behind the cocked position; and said primary and secondary sear surfaces being located on said sear means so that said hammer means pivots to be retained at the cocked position by said primary sear surface when the sear means returns to the first position, thereby maintaining said hammer means ready to pivot to the firing position when said sear means next is moved to the second position.

2. The firing mechanism as in claim 1, further comprising:

trigger means operative to move said sear means from said first position to said second position when pulled; and means operative to return said sear means to said first position when said trigger means is released.

3. The firing mechanism as in claim 1, wherein:

said sear means includes a sear member having said first and second sear surfaces; and said sear member enters said opening in said hammer means as the hammer means is moved to the cocked position, so that said primary and secondary sear surfaces respectively confront said primary and secondary sear engaging surfaces.

4. The firing mechanism as in claim 1, wherein said sear means is disposed for movement on a linear path between said first and second positions.

5. The firing mechanism as in claim 1, wherein said sear means is movable on a straight path between said first and second positions; and further comprising resilient means urging said sear means to said first position whereat said hammer means is retained cocked; and trigger means operative to move said sear means to said second position in opposition to said resilient means, so as to disengage said primary sear surface and allow said hammer means to move to the firing position.

6. The firing mechanism as in claim 5, wherein:

said sear means comprises a sear member extending transverse to said path of travel of the sear means;

said primary and secondary sear surfaces being on opposite sides of said sear member; and said hammer means opening receives said sear member when the hammer means is cocked, so that said primary and secondary sear engaging surfaces of the hammer means respectively confront the primary and secondary sear surfaces of said sear member.

7. The firing mechanism as in claim 6, wherein:

said sear means further comprises elongated means operatively associated with said sear member and extending to a location forwardly of the sear member; and said trigger means when pulled being operable to move said elongated means back, thereby moving said sear member to said second position and thus disengaging said primary sear surface from said hammer means.

8. Apparatus as in claim 7, wherein:

said elongated means comprises a pair of elongated rails extending forwardly from spaced apart locations on said sear member, so that said hammer means can move into the space between said rails without interference; and trigger engaging means bridging said elongated rails forwardly of said hammer means.

9. Apparatus as in claim 8, wherein:

said resilient means urging said sear means comprises a pair of compression springs aligned with said pair of elongated rails so as to urge said trigger engaging means toward said trigger means.

10. In a firing mechanism for a firearm having a frame, bolt means supported in the frame for limited travel, and a firing pin associated with the bolt means, the improvements comprising:

sear means disposed in the frame below the bolt means for travel along a linear path;

means urging said sear means to a first position on said path;

a trigger selectably operative to move said sear means to a second position on said path, in opposition to said urging means;

a hammer pivotably mounted in the frame for movement between a cocked position and a firing position;

means resiliently biasing said hammer for movement toward the firing position;

said hammer having a first surface and a second surface confronting each other and defining an opening in the hammer, and having a first ledge and a second ledge, said first ledge adjacent said first confronting surface and said second ledge adjacent said second confronting surface, said first and second ledges positioned in mutually spaced apart relation across said opening in which said sear means extends as the hammer is in the cocked position;

said sear means including a sear member located to be received in said opening between said ledges when the hammer is in cocked position;

a primary sear surface on said sear member to engage one of said ledges and retain said hammer in cocked position while said sear means is at said first position; and a secondary sear surface on said sear member to engage the other of said ledges when the hammer is pivoted behind the cocked position while said sear means is moved to said second position in response to pulling said trigger, whereby said sear member moves from said other ledge to said one ledge as said trigger is released, permitting said hammer to return to engagement at the cocked position.

11. The firing mechanism as in claim 10, wherein:

said sear member is a cross member transversely extending within said frame substantially behind the pivotal axis of said hammer; and said sear means includes a pair of elongated members engaging said sear member and extending forwardly within the frame toward said trigger, whereby said elongated members and said transverse sear member slide back within said frame along said linear path when said trigger is pulled, so as to disengage said primary sear surface from the confronting ledge on said hammer.

12. The firing mechanism as in claim 11, wherein:

said hammer is located above said elongated members; and further comprising:

means operatively associated with said hammer and defining at least one radius surface engaging and preventing upward movement of at least one of said elongated members, said radius surface not impeding said sliding movement of the elongated members.

* * * * *